US005080182A

United States Patent [19]

Thompson

[11] Patent Number: 5,080,182

[45] Date of Patent: Jan. 14, 1992

[54] METHOD OF ANALYZING AND CONTROLLING A FLUID INFLUX DURING THE DRILLING OF A BOREHOLE

[75] Inventor: Martin Thompson, Histon, England

[73] Assignee: Schlumberger Technology Corporation, Houston, Tex.

[21] Appl. No.: 19,141

[22] Filed: Nov. 28, 1990

[30] Foreign Application Priority Data

Dec. 20, 1989 [GB] United Kingdom ..... 8928795

[51] Int. Cl.[5] ..... E21B 47/10

[52] U.S. Cl. ..... 175/48; 73/155; 175/50

[58] Field of Search ..... 175/48, 50, 25; 73/155

[56] References Cited

U.S. PATENT DOCUMENTS

| | | | |
|---|---|---|---|
| 3,443,643 | 5/1969 | Jones | 175/25 |
| 3,550,696 | 12/1970 | Kenneday | 175/25 |
| 3,740,739 | 6/1973 | Griffin, III et al. | 340/239 R |
| 3,760,891 | 9/1973 | Gadbois | 175/48 |
| 4,253,530 | 3/1981 | Sharki et al. | 175/25 |
| 4,310,058 | 1/1982 | Bourgoyne, Jr. | 175/48 |
| 4,440,239 | 4/1984 | Evans | 73/155 X |
| 4,527,425 | 7/1985 | Stockton | 73/155 |
| 4,606,415 | 8/1986 | Gray, Jr. et al. | 175/24 |
| 4,733,232 | 3/1988 | Grosso | 175/48 X |
| 4,840,061 | 6/1989 | Peltier | 73/155 |
| 4,867,254 | 9/1989 | Gavignet | 175/48 |
| 5,006,845 | 4/1991 | Calcar et al. | 175/48 X |

FOREIGN PATENT DOCUMENTS 0302558 2/1989 European Pat. Off. .

*Primary Examiner*—Hoang C. Dang

*Attorney, Agent, or Firm*—Martin Hyden; John J. Ryberg

[57] ABSTRACT

A method of real time analysis and control of a fluid influx from an underground formation into a wellbore being drilled with a drill string, a drilling and circulating from the surface down to the bottomhole into the drill string and flowing back to the surface in the annulus defined between the wall of the wellbore and the drill string, the method comprising the steps of shutting-in the well, when the influx is detected; measuring the inlet pressure $P_i$ or outlet pressure $P_o$ of the drilling mud as a function of time at the surface; determining, from the increase of the mud pressure measurement, the time $t_c$ corresponding to the minimum gradient in the increase of the mud pressure and controlling the well from the time $t_c$.

13 Claims, 3 Drawing Sheets 9
17
8
16
21
18
3
24
22
4
7
6
19
12
20
13
5
14
15
10
4
1
2

Pi
Pf – PH
Pmin
t1
t2
t3
ts
tc
t4
t
30
32
34

METHOD OF ANALYZING AND CONTROLLING A FLUID INFLUX DURING THE DRILLING OF A BOREHOLE

The invention relates to a method of analysis and control, in real time, of a fluid influx into a hydrocarbon well which occurs during drilling. When, during the drilling of a well, after passing through an impermeable layer, a permeable formation is reached containing a liquid or gaseous fluid under pressure, this fluid tends to flow into the well if the column of drilling fluid, known as drilling mud, contained in the well is not able to balance the pressure of the fluid in the aforementioned formation. The fluid then pushes the mud upwards. There is said to be a fluid influx or "kick". Such a phenomenon is unstable: as the fluid from the formation replaces the mud in the well, the mean density of the counter-pressure column inside the well decreases and the unbalance become greater. If no steps are taken, the phenomenon runs away, leading to a blow-out.

This influx of fluid is in most cases detected early enough to prevent the blow-out occurring, and the first emergency step taken is to close the well at the surface by means of a blow-out preventer.

Once this valve is closed, the well is under control, but only as long as the well pressure does not exceed the formation fracture pressure, otherwise there can result an underground blow-out. A choke valve is used at the surface to relieve, in a controlled manner, the pressure which has been building up in the well. There is a conflict between the need to close the outlet choke valve sufficiently to ensure that the bottomhole pressure remains high enough to be above the formation pressure and so avoid a further influx but low enough to avoid the risk of fracturing the formation higher up the wellbore, the result of which would be an underground blow-out. In addition the well pressure must build up sufficiently to be able to determine enough information about the influx to ensure that subsequent control of the choke valve will be correct. The information that is of particular value to the driller is:

The formation pressure, so that the correct mud weight to be used for the mud circulated to replace the original fluid can be selected and so that the choke valve can be operated to maintain downhole pressure above the formation pressure and so ensure no further influx occurs.

Details of the influx: the crucial information is whether it consists of gas or water or oil. This decides subsequent action in circulating out the influx. The density of the influx if it is gas and the rate at which it is rising up the annulus is sufficient to determine the maximum attainable pressure at the casing shoe and so decide whether or not fracture will occur. Also the volume of the influx is important in determining the subsequent well kill operations as the original volume estimate, which is taken from the surface pit gain, is notoriously inaccurate.

As the pressure builds up in a shut-in well, the influx flow rate falls away until eventually it ceases. It is vitally important to know when the influx has ceased because any further delay in operating the choke valve to reduce wellbore pressure can result in fracturing the formation. However a premature operation of the choke valve would result in a further influx of gas with possible disasterous consequences.

Once the well is under control under the operation of the choke valve, the formation fluid can be safely circulated out and the mud then weighted to enable drilling to continue without danger. If the formation fluid that has entered the well is a liquid (brine or hydrocarbons, for example), the circulation of this fluid does not present any specific problems, since this fluid scarcely increases in volume during its rise to the surface and, therefore, the hydrostatic pressure exercised by the drilling mud at the bottom of the well remains more or less constant. If on the other hand the formation fluid is gaseous, it expands on rising and this creates a problem in that the hydrostatic pressure gradually decreases. To avoid fresh influxes of formation fluid being induced during "circulation" of the influx, in other words while the gas is rising to the surface, a pressure greater than the pressure of the formation has to be maintained at the bottom of the well. To do this, the annulus of the well, this being the space between the drill string and the well wall, must be kept at a pressure such that the bottom pressure is at the desired value. It is therefore very important for the driller to know as early as possible, during circulation of the influx, if a dangerous incident is on the point of occurring, such as a fresh influx of fluid or the commencement of mud loss due to the fracture of the formation.

The usual means of analysis and control available to the driller comprise the mud level in the mud tank, the mud injection pressure into the drill pipes, and the well annulus surface pressure. These three data allow the driller to calculate the volume and nature of the influx, and also the formation pressure. It is on this information that he bases his influx circulation programme.

Interpreting the data nevertheless poses some problems. Firstly, the assessment of the volume of the influx, which is important in order to determine the nature of that influx, is inaccurate. It is in fact made by comparing the mud level in the tank with a "normal" level, i.e. the level that would occur in the absence of the influx. But this reference is difficult to determine: on one hand the mud level changes constantly during drilling, because part of the mud is ejected with the well cuttings; on the other, the mud level in the pits rises when the well is closed, because the mud return lines empty. The estimate of the influx volume is therefore approximate. As a result, determining the nature of the influx is also uncertain. The influx density calculations thus often lead to the conclusion that the influx is a mixture of gas and liquid (oil or water) whereas it may in fact be a gas or a liquid only. It should also be noted that this calculation can not be made when the influx is in a horizontal part of the well.

For all these reasons, influx analysis is not regarded as a reliable technique today.

Several methods have already been proposed for analysing and/or controlling fluid influxes into an oil well from an underground formation being drilled. For example, in U.S. Pat. No. 4,867,254 the value of the mass of gas in the annulus is monitored in order to determine either a fresh gas entry into the annulus or a drilling mud loss into the formation being drilled. In EP patent application 0,302,558, the variations of the flow rate or the pressure of the inlet drilling mud are compared with the variations of the flow rate or the pressure of the outlet mud and, from the comparison, the nature and volume of the influx are determined. Other examples of methods for detecting and/or controlling a fluid influx can be found in U.S. Pat. Nos. 4,840,061; 3,740,739; 3,760,891; 4,253,530 and 4,606,415.

However, the methods of the prior art are often not sufficiently accurate to allow a correct determination of the parameters characterizing the influx and the well conditions. For example, the precise time to open the choke valve in order to control the well is either not described or predicted as being later than necessary.

The present invention offers a method of deriving the required information to analyse and control a fluid influx in a borehole from an analysis of the surface inlet or outlet pressure monitored on a continuous basis when the well is shut-in and operating the choke valve at the right time and in the correct manner. The proposed method may be applied in deviated and even horizontal wells.

More precisely, the invention relates to a method of real time analysis and control of a fluid influx from an underground formation into a wellbore being drilled with a drill string, a drilling mud circulating from the surface down to the bottomhole into the drill string and flowing back to the surface in the annulus defined between the wall of the wellbore and the drill string, wherein the well is shut-in when the influx is detected and wherein the mud pressure, which is the outlet pressure $p_o$ and/or the inlet pressure $p_i$ of the drilling mud, is measured as a function of time at the surface, the method further comprising the steps of determining, from the increase of the mud pressure measurement, the time $t_c$ corresponding to the minimum gradient in the increase of the mud pressure and controlling the well from said time $t_c$.

When inlet pressure $p_i$ is measured, time $t_c$ corresponds to the time when the inlet pressure $p_i$ is substantially equal to the difference between the formation pressure $p_f$ and the hydrostatic pressure $p_H$ created by the density of the drilling mud. The formation pressure $p_f$ is derived by adding the inlet pressure $p_i$ at time $t_c$ to the hydrostatic pressure $p_H$. The rate of change $dp_i$ of the inlet pressure $p_i$ is monitored at time $t_c$, said rate of change being compared with a predetermined value, and the type of influx is determined from said comparison. In addition, the volume and the density of the influx can be derived from the determination of time $t_c$.

The invention applies as well to analysis based on continuously monitored outlet pressure $p_o$. For illustrative purposes only the inlet pressure will be mentioned from now on.

The characteristics and advantages of the invention will be seen more clearly from the description that follows, with reference to the attached drawings, of a non-limitative example of the method mentioned above.

Figure 1:
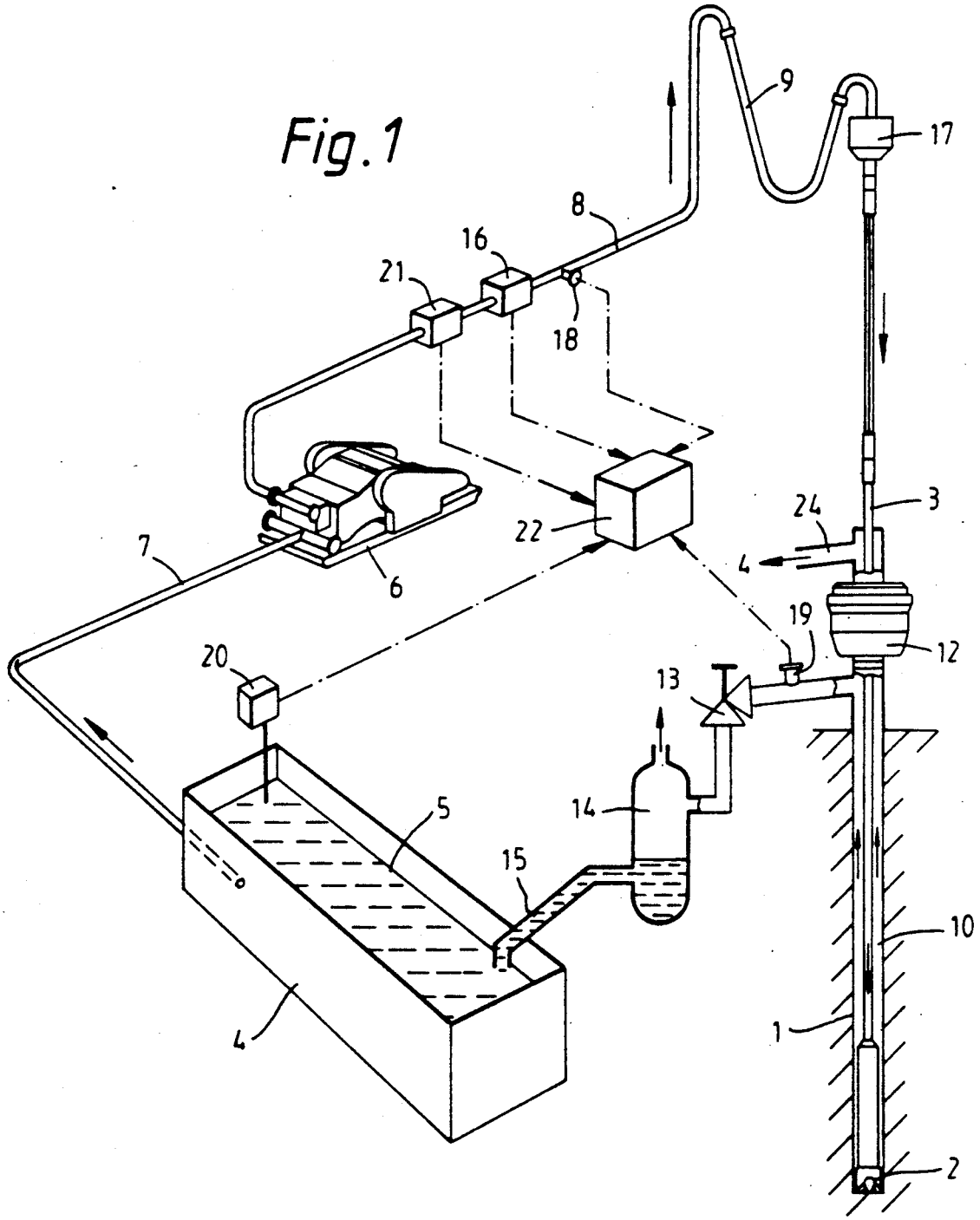
FIG. 1 shows schematically the drilling mud circuit of a well during control of an influx.

FIG. 1 shows the mud circuit of a well 1 during a formation fluid influx control operation. The bit 2 is attached to the end of a drill string 3. The mud circuit comprises a tank 4 containing drilling mud 5, a pump (or several pumps) 6 sucking mud from the tank 4 through a pipe 7 and discharging it into the well 1, through a rigid pipe 8 and flexible hose 9 connected to the tubular drill string 3 via a swivel 17. The mud escapes from the drill string when it reaches the bit 2 and returns up the well through the annulus 10 between the drill string and the well wall. In normal operation the drilling mud flows through a blow-out preventer 12, which is open, into the mud tank 4 through a line 24 and through a vibratory screen not shown in the diagram to separate the cuttings from the mud. When a fluid influx is detected, the blow-out preventer 12 is closed. Having returned to the surface, the mud flows through a choke valve 13 and a degasser 14 which separates the gas from the liquid. The drilling mud then returns to the tank 4 through line 15. The mud inlet flow rate $Q_i$ may be measured by means of a flow meter 16 and the mud density is measured by means of a sensor 21, both of these fitted in line 8. The inlet pressure $p_i$ is measured by means of a sensor 18 on rigid line 8. The outlet pressure $p_o$ is measured by means of a sensor 19 fitted between the blow-out preventer 12 and the choke 13. The mud level in the tank 4 is measured by means of a level sensor 20 fitted in the tank 4. This level will increase if a kick is taken and this pit gain is a simple and basic estimate of the volume of the influx. The sensors are connected to a data acquisition and processing system 22.

In order to exploit the present invention it is sufficient to measure at least $p_i$ or $p_o$ during the shut-in phase, before the choke valve begins to be operated.

Figure 2:
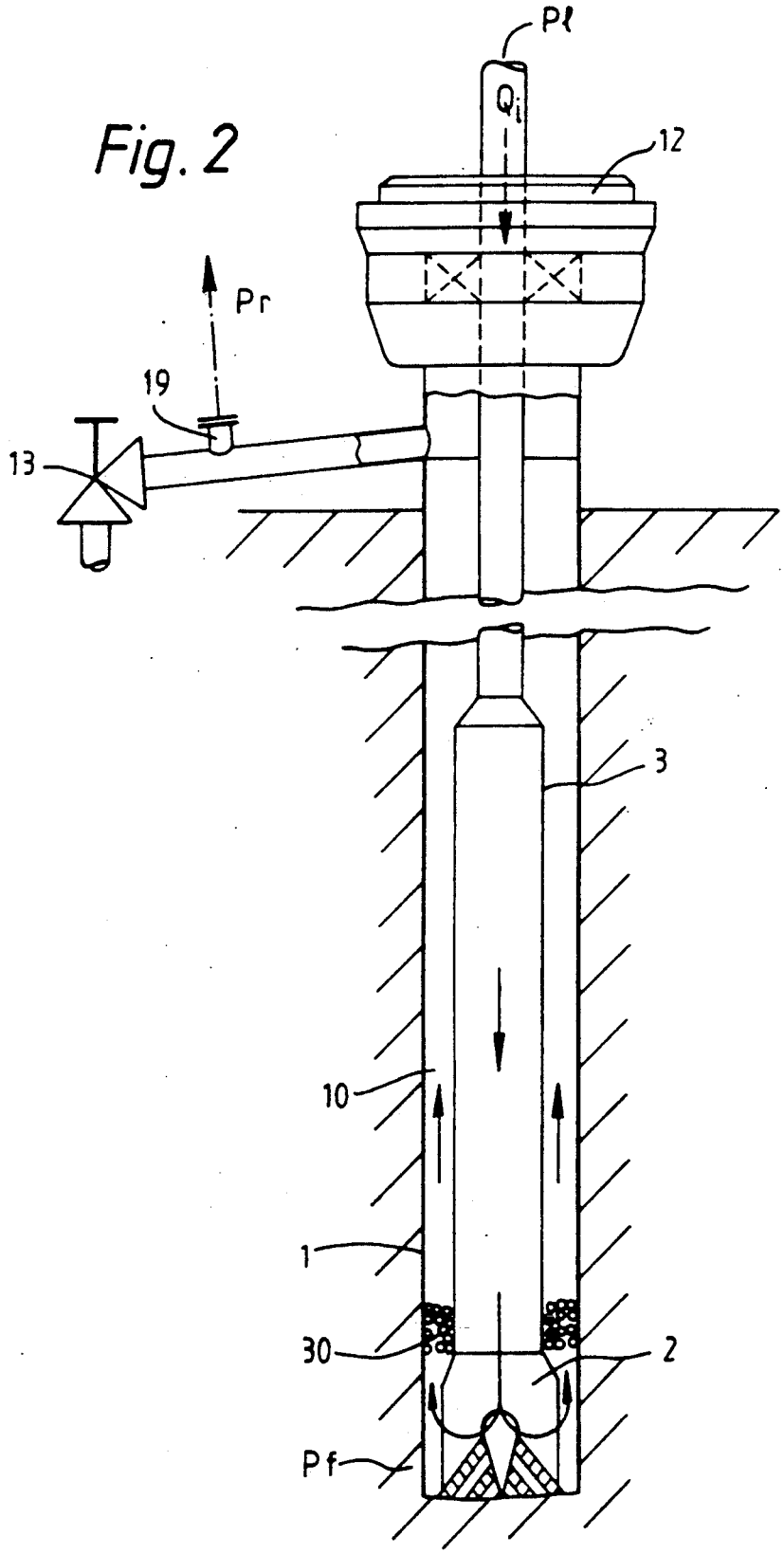
FIG. 2 shows in diagram form the hydraulic circuit of a well during control of a gas influx.

FIG. 2 represents in simplified form the hydraulic circuit of a well when the operator is preparing to circulate the fluid influx 30 that has entered the well. The gas influx 30 produced by the formation being drilled has been represented, rising in the annulus 10. The arrows represented in the drill string 3, the drill bit 2 and the annulus 10 indicate the circulation of the mud when the pumps 6 are working. Immediately after detecting an influx, the pumps are shut down and the blow-out preventer 12 and choke 13 are closed. The well is thus isolated or "shut-in" and the drilling mud is immobilized in the well. The driller then measures at the surface the inlet pressure $p_i$ in the pipes by means of the sensor 8 and the outlet pressure $p_o$ in the annulus by means of sensor 19 between the wellhead and the control choke 13.

For the sake of clarity in explaining the method it is assumed here that the section of the annulus has a constant area A from the bottom to the top of the well. But the method may be used even if this section is not of constant area.

Figure 3:
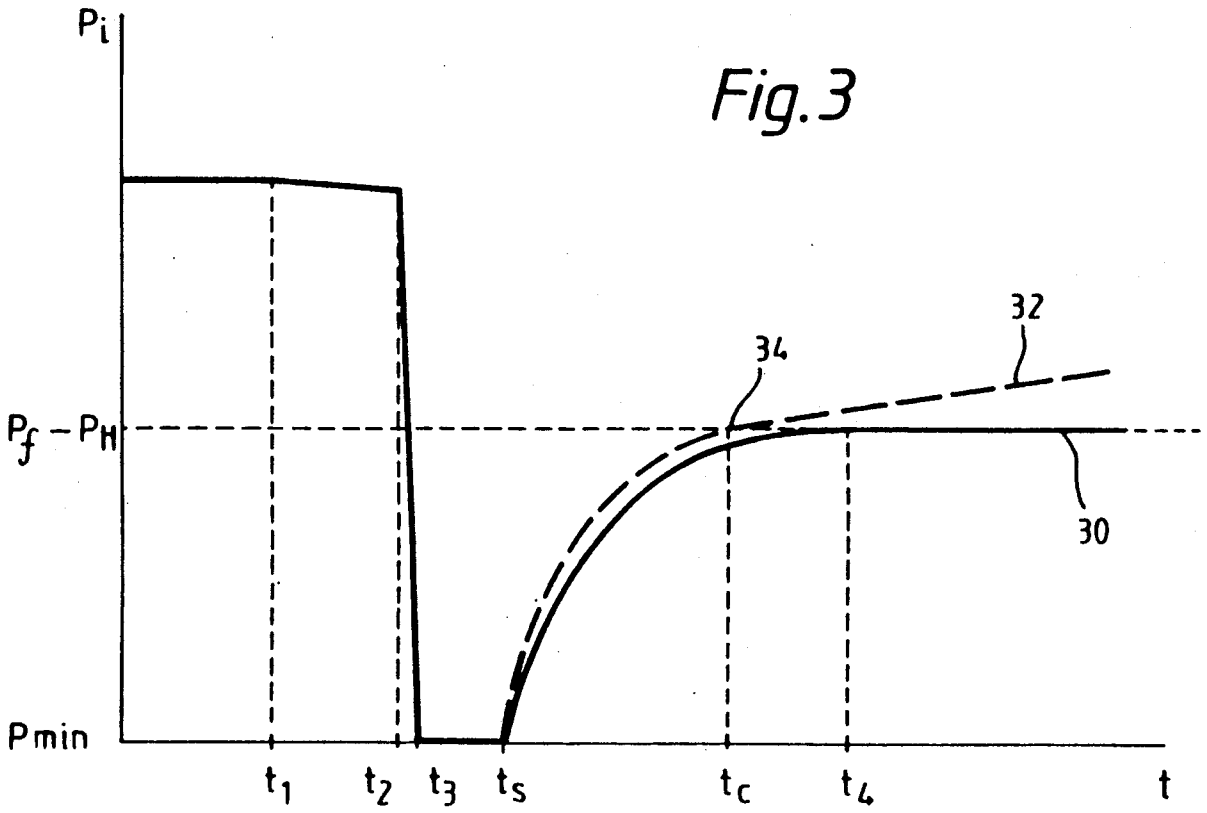
FIG. 3 shows an example of inlet pressure $p_i$ as a function of time, as predicted by the prior art and as observed during a numerical simulation of a gas kick, in accordance with the present invention.

FIG. 3 shows the variations of the mud inlet pressure $p_i$ as a function of time t during a kick, which is detected and controlled by closing the blow-out preventer 12. Curve 30 represented in plain line represents the usual field expectation of variation of $p_i$, and curve 32 in dashed lines represents the expected variation of $p_i$ in accordance with the present invention. The kick begins at time $t_1$. Before that the inlet pressure $p_i$ is relatively constant. From time $t_1$ to $t_2$, $p_i$ decreases very slightly until time $t_2$ when the kick is detected. The period of time $(t_2-t_1)$ between the start of the kick and its detection could be, say 5 minutes depending on formation productivity. At time $t_2$, the mud pumps are stopped. The inlet pressure $p_i$ falls sharply during a few seconds down to a minimum pressure $p_{min}$ at time $t_3$. The blow-out preventer is fully closed at time $t_s$ which is usually called the shut-in time. The elapsed time between $t_2$ and $t_s$ is the time it takes to close the blow-out preventer (about 1 minute). At time $t_s$ the inlet pressure $p_i$ rises until it reaches a constant value equal to the difference between the formation pressure $p_f$ and the hydrostatic pressure $p_H$. The period of time to reach this value is of the order of 5 to 10 minutes depending on formation productivity and includes the recovery time of the formation. The well is shut-in completely since the pumps 6 are stopped and the blow-out preventer 12 and the choke valve 13 are closed. From the time $t_s$ the well is shut-in, the pressure $p_i$ begins to increase for two reasons:

a) The mass of the fluid influx in the wellbore keeps increasing as long as more and more fluid is produced by the formation into the wellbore. Since the volume of the wellbore is constant, the pressure $p_i$ will increase until the influx shuts itself off.

b) If the influx is gas, it rises up the annulus at some slip velocity relative to the mud. As it rises within a fixed volume (the well is shut-in), the pressure increases as the gas can only expand a very limited amount.

The manner in which the pressure builds up is a function of the volume and compressibility of the mud system and of the influx, the rate at which the influx was flowing from the formation when the blow-out preventer was closed as well as the rate of rise of the influx fluid in the annulus if it is gas.

It is usual field practice, in recognition of phenomenon (a) above, to wait until the surface pressure ceases to increase (when $p_i = p_f - p_H$ on FIG. 3 after the time $t_s$) and to identify this instant as the time at which the influx ceased. From the value of the surface pressure at this time, the formation pressure, the influx density and the manner in which to control the choke valve are determined.

However all of this information is deficient in the case of a gas influx, as recognised in the present invention, because the shut-in pressure never actually ceases to increase due to the phenomenon (b) above mentioned. The influx density calculation can consequently be grossly in error and the formation pressure estimate wrong.

The usual field practice described above stems from the knowledge that the bottomhole pressure $p_w$ is lower than the formation pressure $p_f$ (since an influx is flowing from the formation into the borehole) and the bottomhole pressure $p_w$ increases until it meets the formation pressure $p_f$, beyond which time there is no further influx of fluid from the formation into the borehole. At that time, the inlet pressure $p_i$ is equal to the formation pressure $p_f$ minus the hydrostatic pressure $p_H$. The formation pressure $p_f$ and the hydrostatic pressure $p_H$ being constant, the inlet pressure $p_i$ reaches a constant value equal to $(p_f - p_H)$. This is illustrated by the curve 30 in plain line, after the time $t_s$, on FIG. 3.

However, this is not realistic and the inventor of the present invention has demonstrated that in fact the inlet pressure $p_i$ can be given by the following two equations:

$$p_i = A(1 - e^{-c_2 t}) \quad (1)$$

from the time $t = t_s$ to the time $t = t_c$, and $$p_i = B + c_1(t - t_c) \quad (2)$$

from and after the time $t_c$, wherein A, B, $c_1$ and $c_2$ are constants.

By taking:

$$A = (p_f - p_H) + c_1/c_2$$

$$B = (p_f - p_H)$$

the two first equations become:

$$p_i = \left\{ (p_f - p_H) + \frac{c_1}{c_2} \right\} \{1 - e^{-c_2 t}\} \quad (1a)$$

from the time $t = t_s$ to the time $t = t_c$, and $$p_i = (p_f - p_H) + c_1(t - t_c) \quad (2a)$$

from and after the time $t_c$.

The time $t_c$ is defined as the time when the influx stops and therefore the time when $p_f = p_w$. $c_1$ and $c_2$ are constants defined hereafter.

A non-uniform geometry modifies the detail of these expressions but not the principle being described.

As a fact, it is then necessary to add on the right member of equation (2) a third term equal to $+E(t - t_c)^2$, E being an arbitrary coefficient introduced to account for the departure from linearity of equation (2) caused by changes in area as the gas leaves the region of the drill collars.

In FIG. 3, curve 32 in dash lines represents the variation of inlet pressure $p_i$ during a shut-in period, in accordance with equations (1) and (2).

The time $t_c$ can be determined directly from the measurement of the inlet pressure $p_i$, as the inflection point 34 of curve 32 or the point of minimum gradient. This is because the minimum gradient in the increase of $p_i$ versus time occurs precisely for $t = t_c$ (point 34). The determination of the minimum gradient can be done for example by plotting the curve 32 with the pressure measurement versus time or with the help of a computer.

Another way to determine $t_c$ is to do it by computational means. The way to do so is to match the measured data $p_i$ versus time with predictions of $p_i$ from equations (1) and (2) based on assumed values of $c_1$, $c_2$, A and B and refining the assumed values until a good match is obtained. The match is obtained when the limit $t_c$ is found for the two equations (1) and (2), when equation (1) is not valid anymore and equation (2) starts to apply. The same curve fitting process can obviously apply starting from equations (1a) and (2a).

When equation (1) applies, for times less than $t_c$, we have unknown parameters $p_f$, $c_1$, $c_2$ and when equation (2) applies, for times exceeding $t_c$, we have unknown parameters $c_1$ and $p_f$.

A value for the time $t_c$ is first assumed. Then it is a straightforward matter to use least squares or some other appropriate curve fitting method to determine $p_f$, $c_1$, $c_2$ from the region $o < t < t_c$, comparing measurements with predictions of equations (1a) and $c_1$, $p_f$ from the region $t_c < t$ comparing measurements with predictions of equation (2a). Having done this with the assumed value of $t_c$, there are several further conditions to be met. Namely that the two curves must coincide at time $t_c$ and that gradients of the curves at time $t_c$ must match. Furthermore the parameters $p_f$ and $c_1$ found from the curve fitting process with equation (1a), on the one hand, and from the curve fitting process with equation (2a) on the other hand, must be consistent. If these conditions are not met, then the time $t_c$ is adjusted. The process is repeated iteratively until these conditions are met and then all the parameters $t_c$, $c_1$, $c_2$ and $p_f$ are known.

The determination of $t_c$ calls for several remarks. In the method usually applied in the field, the time $t_4$ to open the choke valve when $p_i$ does not increase anymore (when $p_i = p_f - p_H$ on FIG. 3) is difficult to determine with accuracy since $p_i$ rises asymptotically toward a plateau. The driller is therefore not really sure of the right instant to open the choke valve. By comparison, the curve 32 cuts the horizontal line $(p_f - p_H)$ at point 34, going over that line. Time $t_c$, which corresponds to the point of minimum gradient at the intersection between this horizontal line and curve 32, is therefore easy to determine. The driller, who in accordance with the present invention, opens the choke valve at time $t_c$, knows perfectly well the right instant to do it.

A second remark is that the inlet pressure $p_i$ continues to increase (curve 32) after the time $t_c$, contrary to the usual belief that $p_i$ reaches a constant value and stops rising for a while.

Another remark is that time $t_c$ occurs before time $t_4$ of the prior art. As a consequence, there is a higher risk to fracture the formation with the usual field practice, particularly since $p_i$ continues to increase after time $t_c$. It is therefore very important to determine precisely the time $t_c$. In addition, the accuracy of other parameter values depends on the precision in determining $t_c$, since $t_c$ is used later on to determine other parameters. It may be noted that the use of both equations (1) and (2) to determine $t_c$ implies that time $t_c$ is passed before it is determined. This is true but is not of any consequence. The driller will then known the true $t_c$ and would always delay for a short period the opening of the choke in order to give a margin of safety in controlling the downhole pressure to be not just at the formation pressure but marginally above it.

When time $t_c$ has been determined, in accordance with the present invention, the inlet pressure $p_i$ is determined at time $t_c$, for example directly from the pressure measurement. If no measurement was made at that particular time $t_c$, then the value of $p_i$ at time $t_c$ is extrapolated from the measurement made right before and after $t_c$.

Then the formation pressure $p_f$ at time $t_c$ is calculated in order to better control the opening of the choke valve and to determine the mud density sufficient to kill the well. The formation pressure is given by:

$$p_f = p_i + p_H$$

Any error on the determination of $t_c$ and subsequently $p_i$ leads to a same error on the value of $p_f$. This is important since the driller has to keep the bottomhole pressure at least equal to the formation pressure, and therefore the inlet pressure $p_i$ large enough, by adjusting the opening of the choke valve. Any error on the value of $p_f$ leads therefore to a wrong control of the choke valve. The hydrostatic pressure $p_H$ is determined, as known in the art, from the density $d_m$ of the mud presently in the well and from the true vertical depth.

It must be realized that, if the curve fitting method has been used to obtain $t_c$, as explained previously, then the value of $p_f$ is also obtained at the same time, together with the values for $c_1$ and $c_2$.

In order to determine the type of influx, gas or liquid, the rate of change of inlet pressure $dp_i$ is computed from the measured data at the time $t_c$. If the rate $dp_i$ is very small, less than say 0.03 bar/min, then the influx is not gas. This can be ascertained even in a horizontal well.

In accordance with one characteristic of the invention, the volume of influx $V_o$ is determined. The inventor has determined that the constant $c_1$ of equation (1) is given by:

$$c_1 = \frac{V_o\, d_m\, g\, v_g}{V_o + p_H X_m V_m} \tag{3}$$

wherein $p_H$ is the hydrostatic pressure, $X_m$ the compressibility of the mud in the well, $V_m$ the volume of the mud in the well (drill string and annulus) $d_m$ is the density of the mud, g is the gravitational acceleration and $v_g$ is the rate of rise of the gas in the annulus. The value of $v_g$ is obtained from experimental conditions in flow simulators and is therefore known.

From the time derivative of equation (2), the rate of change $dp_i$ of inlet pressure is:

$$dp_i = c_1$$

$c_1$ can thus be determined by determining the rate of change of $p_i$ at time $t_c$.

Writing equation (3) for $V_o$ and substituting $c_1$ by $dp_i$, one obtains:

$$V_o = \frac{p_H X_m V_m\, dp_i}{d_m\, g\, v_g - dp_i} \tag{4}$$

The compressibility $X_m$ of the mud is known or can be determined easily. The rate of rise $dp_i$ of the inlet pressure has been determined previously and, the other parameters of equation (4) being known, then the value of $V_o$ can be computed. The volume of influx so determined is a better estimate than the one obtained with the usual pit gain measurement.

There will be situations where the operator is more confident in the pit gain measurement than in the value of $V_o$ derived from equation (4) wherein an estimate of rate of rise of gas $v_g$ is inferred. In that case, the value of $v_g$ is obtained from equation (4) using for $V_o$ the pit gain.

However, if the difference $(Q_o - Q_i)$ between the outlet flow rate $Q_o$ and inlet flow rate $Q_i$ has been measured between times $t_2$ and $t_5$ on FIG. 3, then the volume $V_o$ of influx can be estimated from the following expression, derived by the inventor, of the constant $c_2$ of equation (1):

$$c_2 = \frac{(Q_o - Q_i)}{(p_f - p_H)} \quad \frac{1}{V_o/p_H + X_m V_m} \tag{5}$$

so that:

$$V_o = p_H \frac{(Q_o - Q_i)}{c_2\,(p_f - p_H)} - p_H X_m V_m \tag{6}$$

According to a further aspect of the invention, the density of the influx $d_g$ is determined, even if the well is deviated from the vertical, as follows:

In a well with constant annulus area S the density of the influx $d_g$ is determined from a comparison of the inlet and outlet pressure at time $t_c$.

$$p_o - p_i - p_{fr} = (d_m - d_g)\, g \frac{V_o}{S} \cos a \tag{7}$$

where a is the angle of inclination of the drill collars from vertical, and the frictional pressure drop $p_{fr}$ is due to the relative motion of the gas with respect to the mud. This term is small and would be ignored if not test work was available to give an estimate of the value.

This expression for the influx density $d_g$ will indicate whether there is gas, oil or water entering the wellbore. When non-constant area annuli are considered then due account would need to be taken of the area changes in the relationship (7).

The prefered mode of the invention has been described with respect to measuring inlet pressure $p_i$. However, the invention may also be practised in an equivalent manner by measuring outlet pressure $p_o$ as it varies with time. Equation (7) is a relationship between outlet pressure $p_o$ and inlet pressure $p_i$ during the shut-in, but only as long as the annulus area is constant. This expression contains unknown terms such as the fluid density $d_g$, the frictional pressure $p_f$, and the volume of influx $V_o$ is often poorly estimated by pit gain measurements. However, even with a non-constant annulus cross sectional area, to a good approximation $$p_o - p_i = \text{constant},$$

where the constant is at present unknown. Thus all of the subsequent discussion relating to the use of $p_i$ to determine $t_c$, $p_f$, $c_1$, $c_2$ can be applied to $p_o$ where the unknown constant will be determined from the difference $$(p_o - p_i) \text{ at time } t_c.$$

As an example, the variation of the outlet pressure $p_o$ versus time, after the shut-in time $t_s$, follows a curve similar to curve 32 on FIG. 3. From this $p_o$ curve, time $t_c$ is determined corresponding to the point of minimum gradient, and the values of the constants $c_1$ and $c_2$ are derived from this $p_o$ curve, as before. Then, if $p_i$ has also been measured, the formation pressure $p_f$, the volume $V_o$ and density $d_m$ are determined as previously.

I claim:

1. A method of real time analysis and control of a fluid influx from an underground formation into a wellbore being drilled with a drill string, a drilling mud circulating from the surface down to the bottomhole into the drillstring and flowing back to the surface in the annulus defined between the wall of the wellbore and the drill string, said method comprising the steps of:

a) detecting an influx of fluid into the well from the formation;

b) ceasing circulation of drilling mud and shutting in the well;

c) monitoring either inlet pressure or outlet pressure of the mud as a function of time when the well is shut in so as to observe development thereof;

d) determining from the monitored pressure the time $t_c$ when the pressure development with respect to time changes from (1) substantially $p=A(1-=e^{-C_2 t})$ to (2) substantially $p=B+C_1(t-t_c)$ wherein A, B, $C_1$ and $C_2$ are constants and t is the time; and e) allowing fluid to flow from the well in a controlled fashion from time $t_c$ so as to remove the influx from the well.

2. The method of claim 1 wherein the inlet pressure $p_i$ is measured and wherein said time $t_c$ corresponds to the time when the inlet pressure $p_i$ is substantially equal to the difference between the formation pressure $p_f$ and the hydrostatic pressure pH of the drilling mud.

3. The method of claim 2 wherein the hydrostatic pressure pH is computed from the mud density $d_m$ and the drilled depth and wherein the formation pressure pf is derived by adding the inlet pressure $p_i$ at time $t_c$ to the hydrostatic pressure pH.

4. The method of claim 1 wherein the rate of change dp of the mud pressure is monitored at time $t_c$, said rate of change is compared with a predetermined value and the type of influx is determined from said comparison.

5. The method of claim 1 wherein the time $t_c$ is determined by matching the measurement of inlet pressure $p_i$ versus time with predictions of $p_i$ values from equations (1) and (2) based on assumed values of A, B, $C_1$ and $C_2$ and refining the assumed values until a good match is obtained.

6. The method of claim 1 wherein $$A=(pf-pH)+C_1/C_2$$

$$B=pf-pH$$

in which pf is the formation pressure and pH is the hydrostatic pressure of the mud.

7. The method of claim 6 wherein the value of pH is computed from the values of mud density $d_m$ and the drilled depth and, simultaneously with the determination of $t_c$, the values of pf, $c_1$ and $c_2$ are determined.

8. The method of claim 1 wherein the rate of change $dp_i$ of the inlet pressure $p_i$ is determined at time $t_c$ and the value of $c_1$ is taken equal to said rate of change $dp_i$.

9. The method of claim 1 wherein the rate of change dp of the mud pressure is determined at time $t_c$ and the volume $V_o$ of the influx is computed from the equation:

$$V_o = \frac{p_H X_m V_m dp}{d_m g v_g - dp}$$

in which pH is the hydrostatic pressure of the mud, $X_m$ is the compressibility of the mud, $V_m$ is the volume of the mud in the wellbore, $d_m$ is the density of the mud, g is the gravitational acceleration and $v_g$ is the mean rate of rise in the influx in the wellbore.

10. The method of claim 1 wherein the rate of change dp of the mud pressure is determined at time $t_c$, the pit gain volume $V_o$ is measured and the mean rate of rise $v_g$ of the influx in the wellbore is computed from the equation:

$$V_o = \frac{p_H X_m V_m dp}{d_m g v_g - dp}$$

in which pH is the hydrostatic pressure of the mud, $X_m$ is the compressibility of the mud, $V_m$ is the volume of the mud in the wellbore, $d_m$ is the density of the mud and g is the gravitational acceleration.

11. The method of claim 5 wherein the inlet flow rate $Q_i$ and outlet flow rate $Q_o$ of the drilling mud are measured and the volume $V_o$ of the influx is computed from the equation:

$$V_o = \frac{p_H (Q_o - Q_i)}{C_2 (pf - p_H)} - p_H X_m V_m$$

in which pH is the hydrostatic pressure of the mud, pf is the formation pressure, $X_m$ is the compressibility of the mud and $V_m$ is the volume of the mud in the wellbore.

12. The method of claim 1 wherein the outlet pressure $p_o$ and inlet pressure pi of the mud are measured or determined at time $t_c$, and the density $d_g$ of the influx is derived from said values of $p_o$ and $p_i$.

13. The method of claim 12 wherein the type of influx is determined from said density $d_g$ of the influx.

* * * * *